United States Patent [19]

Ueyama

[11] Patent Number: 4,983,445

[45] Date of Patent: Jan. 8, 1991

[54] THERMAL PRINTING RIBBON

[75] Inventor: Seiji Ueyama, Hirakata, Japan

[73] Assignee: General Company Limited, Osaka, Japan

[21] Appl. No.: 291,371

[22] Filed: Dec. 23, 1988

Related U.S. Application Data

[63] Continuation of Ser. No. 894,213, Aug. 7, 1986, abandoned.

[30] Foreign Application Priority Data

Aug. 12, 1985 [JP] Japan ..... 60-175799
Aug. 12, 1985 [JP] Japan ..... 60-175800

[51] Int. Cl.[5] ..... B41M 5/26

[52] U.S. Cl. ..... 428/212; 428/195; 428/484; 428/488.4; 428/497; 428/500; 428/522; 428/913; 428/914

[58] Field of Search ..... 428/202, 203, 207, 321.1, 428/348, 484, 488.1, 488.4, 913, 914, 195, 212, 497, 500, 522

[56] References Cited

U.S. PATENT DOCUMENTS 3,944,695 3/1976 Kosaka et al. ..... 428/488.1
4,555,436 11/1985 Guertson ..... 428/484
4,559,273 12/1985 Kutsukake et al. ..... 428/480
4,592,946 6/1986 Shuman ..... 428/488.1
4,617,224 10/1986 Hotta etal. ..... 428/488.4
4,698,268 10/1987 Ueyama ..... 428/488.4

FOREIGN PATENT DOCUMENTS 3315249 10/1984 Fed. Rep. of Germany ... 428/488.4
0144751 12/1978 Japan ..... 428/488.1
0101094 6/1983 Japan ..... 428/488.1

*Primary Examiner*—Bruce H. Hess
*Attorney, Agent, or Firm*—Wegner, Cantor, Mueller & Player

[57] ABSTRACT

A heat-sensitive transferring recording medium comprises a heat-resistant substrate, a heat-sensitive releasing layer and a heat-sensitive transferring ink layer, and the ink layer mainly comprises 50–80 wt. % polyethylene resin having a melting point or softening point of 60°–150° C., molecular weight of 1,000–100,000, penetration of 20 or less (at 25° C.) (JIS K 2235), and melting viscosity of 100–10,000 cps (at 140° C.), 0–30 wt. % wax having a melting point of 50°–110° C., and 5–45 wt. % coloring agent.

A heat-sensitive transferring recording medium comprises a heat-resistant substrate, a heat-sensitive releasing layer melting at 50°–100° C. and a heat-sensitive transferring ink layer.

13 Claims, No Drawings

THERMAL PRINTING RIBBON

This application is a continuation of U.S. application Ser. No. 894,213 filed Aug. 7, 1986, now abandoned.

BACKGROUND OF THE INVENTION

1. Field of the Invention

This invention relates to a heat-sensitive transferring recording medium and more particularly, to a heat-sensitive transferring recording medium used for a heat-sensitive transferring recording apparatus such as thermal facsimile and thermal printer.

2. Related Background Art

Non-impact type heat-sensitive recording systems have recently drawn public attention since they have the advantages of decreased noise and easy handling. The conventional heat-sensitive recording systems are free from noise and do not need any development and fixation, and the handling is easy, but do suffer from problems of falsification and storage.

In order to solve such problems, there have been proposed heat-sensitive transferring recording methods which comprise forming a heat melting ink layer on a substrate and superimposing a receiving paper (recording paper) on the heat melting ink layer, heating the substrate with a thermal head, and melting the heat melting ink layer to transfer the melted portion of the heat melting ink layer to a receiving paper composed of a plain paper.

However, these heat-sensitive transferring recording methods suffer from the following problems. That is, though good print can be obtained when the degree of smoothness of the receiving paper composed of a plain paper is high, uneveness of the surface of the receiving paper results in that there are some portions contacting the receiving paper and some portions not contacting the receiving paper when the degree of smoothness of the receiving paper is low, for example, Bekk smoothness is 50 sec. or less, and as a result, the transferring efficiency becomes low to form voids and lower the sharpness. Moreover, the fluidity of the heat melting ink is so high that the heat melting ink penetrates the receiving paper and reaches the inside, resulting in lower density. Therefore, good print can not be produced.

SUMMARY OF THE INVENTION

An object of the present invention is to provide a heat-sensitive transferring recording medium of high transferring efficiency and producing sharp and clear print of high density free from voids.

According to the present invention, there is provided a heat-sensitive transferring recording medium which comprises a heat-resistant substrate, a heat-sensitive releasing layer and a heat-sensitive transferring ink layer laminated in this order, the heat-sensitive transferring ink layer mainly comprising (a) a polyethylene resin having a melting point or softening point of 60°-150° C., molecular weight of 1,000-100,000, penetration of 20 or less (at 25° C.)(JIS K 2235) and melting viscosity of 100-10,000 cps (at 140° C.), (b) a wax having a melting point of 50°-110 C., and (c) a coloring agent, and the contents of (a), (b) and (c) components being 50-80 % by weight, 0-30% by weight and 5-45% by weight after dried, the total of (a), (b) and (c) being 100% by weight.

According to another aspect of the present invention, there is provided a heat-sensitive transferring recording medium which comprises a heat-resistant substrate, a heat-sensitive releasing layer melting at 50°-100° C. and a heat-sensitive transferring ink layer laminated in this order.

DESCRIPTION OF THE PREFERRED EMBODIMENTS

A heat-resistant substrate used in the present invention includes a thin paper of 20μ or less thick such as glassine, condenser paper and the like, and a heat-resistant film of 10μ or less thick such as polyester, polyimide, nylon, polypropylene films and the like.

Plastic films of 2-10μ thick are preferred. In order to enhance the heat resistance of a heat-resistant substrate, there may be provided a heat-resistant protective layer.

As the polyethylene in the heat-sensitive transferring ink layer used in the present invention, there may be used low molecular weight polyethylene of oxide type having an acid value of 5-30, low molecular weight polyethylene of a copolymer type containing 5-40% by weight of vinyl acetate, low molecular weight polyethylene of a copolymer type containing 5-15 % by weight of an organic acid (for example, acrylic acid), and their emulsions or dispersions. The characteristic penetration of the polyethylene resin is determined by standard methods of Japanese Standards Association in which the penetration is determined by the use of penetrator device and testing method as outlined below. After melting a sample by heating and placing in a sample vessel and allowing to cool by standing, it is kept at a fixed temperature in an isothermal water bath. A specified needle, the total mass of which is made to be 100 g, is penetrated vertically into the sample for 5 sec. The penetrated depth of needle is measured to the nearest 0.1 mm and expressed as the penetration of sample by the numerical value (absolute number) obtained by multiplying it 10 times.

As waxes used in the heat-sensitive transferring ink layer of the present invention, there may be used paraffin wax, microcrystalline wax, carnauba wax, shellac wax, montan wax and higher fatty acids.

Emulsions thereof may be also used. For example, as a wax emulsion, there may be used emulsions of paraffin wax, microcrystalline wax, carnauba wax, shellac wax and montan wax.

As a coloring agent for the heat-sensitive transferring ink layer used in the present invention, there may be mentioned pigments such as carbon black, iron oxide, prussian blue, lake red, titanium oxide and the like, and dyes such as basic dyes, neozapon dyes and the like.

As other components for the heat-sensitive transferring ink layer, there may be used a filler, for example, extender pigments such as calcium carbonate, clay and the like and a softening agent such as various animal oils, vegetable oils, mineral oils and the like.

Further, it is effective for decreasing the energy necessary for heat-sensitive head to provide a heat-sensitive releasing layer between a substrate and a heat-sensitive transferring ink layer. The releasing layer may be formed by using silicone, celluloses, and waxes, alone or in combination. Further, they may be used together with pigments such as carbon black, calcium carbonate, clay, talc and the like dispersed therein.

Preferably a releasing layer capable of melting at 50°-100 ° C. is used. Examples of compositions of the releasing layer are as shown below. (In each of A and B below, the total of the components is 100 wt. %.)

A:

Wax: 90–40 wt. %

Thermoplastic resin: 0–40 wt. %

Softening agent: 0–30 wt. %

B:

Wax: 100–30 wt. % mp. 50°–100° C.

One or more thermoplastic resins: 10–60 wt. % mp. 60°–150° C.

Softening agent: 0–30 wt. % liquid at room temperature

C: One or more selected from rosin and its derivatives, terpene resin, hydrocarbon resins, α-methylstyrene-vinyltoluene copolymer, low molecular weight styrene resins, and coumarone-indene resin.

D: Wax emulsions

Components for the releasing layer melting at 50°–100° C. used in the present invention are as shown below. Waxes such as paraffin wax,
microcrystalline wax,
carnauba wax,
shellac wax,
montan wax,
higher fatty acids,
higher fatty acid amides,
higher alcohols,
higher fatty acid metal soap,
and the like.

As wax emulsions, emulsions of the above-mentioned various waxes may be used.

Thermoplastic resins such as ethylene-vinyl acetate copolymer, polyamide, polyethylene, polyester, and the like.

Resins exhibiting low viscosity when melted such as rosin and its derivatives, terpene resin, hydrocarbon resins of aliphatic type, aromatic type, aliphatic-/aromatic copolymer type, alicylic compound type, or the like, α-methylstyrene-vinyltoluene copolymer, low molecular weight styrene resin, coumarone-indene resin, and the like.

They may be used alone or in combination. When they are used together with hydrogenated hydrocarbon resins or low molecular weight styrene resins, good results are obtained.

As a softening agent, there may be used various animal oils, vegetable oils or mineral oils.

As a heat-resistant protective layer, there may be used higher fatty acid, fluorocarbon resin, silicone resin or the like.

Where the heat-sensitive releasing layer can melt at a temperature ranging from 50° C. to 100° C., a conventional heat-sensitive transferring ink layer may be used, and it is preferred that the heat-sensitive transferring ink layer is composed of the components (a), (b) and (c) (50–80% by weight, 0–30% by weight and 5–45% by weight, respectively) as mentioned above.

The heat-sensitive transferring recording medium may be produced by the following method.

The above-mentioned wax, thermoplastic resin, and softening agent, or wax-emulsion, or a styrene oligomer, and hydrogenated petroleum resin are mixed or dispersed, and the resulting mixture or dispersion is applied to a heat-resistant substrate by hot-melt coating or solvent coating followed by drying to produce a heat-sensitive releasing layer.

Then, to the surface of the heat-sensitive releasing layer is applied a mixture of the above-mentioned polyethylene resin, wax and coloring agent dispersed in a solvent or a molten mixture of the components.

When the emulsion or dispersion is used, polyethylene emulsion, wax emulsion, and coloring agent are dispersed in water by means of a dispersing machine such as a ball-mill or attritor, to produce an ink. When a commercially available coloring agent dispersion is used as a coloring agent, it is necessary only to simply mix and agitate the above-mentioned components.

The resulting ink coating material is applied to a substrate by means of a hot melt type or solvent type coating machine followed by solidifying or drying. Where a heat-resistant protective layer is provided on a surface of the substrate opposite to the ink layer, a component such as higher fatty acid, fluoro-carbon resin, silicone resin or the like as mentioned above is mixed with and dispersed in a solvent and applied to the opposite surface followed by drying. The thickness of the heat-sensitive transferring ink layer is preferably 2–10μ.

EXAMPLES 1–19

To the upper surface of a 4μ thick PET (polyethylene terephthalate) was applied a fatty acid amide in the thickness of 1μ to form a heat-resistant protective layer, and to the other surface was applied a coating material comprising a resin such as silicone, ethyl cellulose polyamide, polyethylene, and coumarone-indene and the like, wax such as microcrystalline wax, montan wax and the like, a wax emulsion such as microcrystalline wax emulsion, montan wax emulsion and the like and/or a plasticizer and others as shown in the examples in the following tables, to produce a 2μ thick heat-sensitive releasing layer.

To the surface of the resulting heat-sensitive releasing layer was applied a coating material composed of a resin such as low molecular weight polyethylene and the like, and/or wax such as carnauba wax, paraffin wax, emulsions thereof and the like, and/or a softening agent, and a coloring agent to produce a 4μ thick heat-sensitive transferring ink layer.

EXAMPLE 1-10 (1)

| | Material | EXAMPLE No. 1 | 2 | 3 | 4 | 5 | 6 | 7 | 8 | 9 | 10 |
|---|---|---|---|---|---|---|---|---|---|---|---|
| Heat-resistant protective layer | Fatty acid amide | ○ | ○ | ○ | ○ | ○ | ○ | ○ | ○ | ○ | ○ |
| Substrate | PET(Polyethylene terephthalate) 4μ | ○ | ○ | ○ | ○ | ○ | ○ | ○ | ○ | ○ | ○ |
| Heat-sensitive releasing layer | Silicone resin | | ○ | ○ | ○ | ○ | ○ | ○ | ○ | ○ | ○ |
| | Ethyl cellulose | | 40 | 50 | 80 | 85 | | | | | |
| | Oxide type low molecular weight PE | | | | | | 60 | | | | |
| | Vinyl acetate copolymer type low molecular | | | | | | | | | | |

-continued

EXAMPLE 1-10 (1)

| | Material | EXAMPLE No. 1 | 2 | 3 | 4 | 5 | 6 | 7 | 8 | 9 | 10 |
|---|---|---|---|---|---|---|---|---|---|---|---|
| | weight PE | | | | | | | | | | |
| Heat-sensitive transferring ink layer | Acrylic acid copolymer type low molecular weight PE | | | | | | | 60 | | | |
| | Low molecular weight polyethylene A | | | | | | | | 70 | | |
| | Dispersion of low molecular weight polyethylene A | | | | | | | | | 60 | |

EXAMPLE 1-10 (2)

| | Material | EXAMPLE No. 1 | 2 | 3 | 4 | 5 | 6 | 7 | 8 | 9 | 10 |
|---|---|---|---|---|---|---|---|---|---|---|---|
| | Low molecular weight polyethylene B | | | | | | | | | | 55 |
| Heat-sensitive transferring ink layer | Carnauba wax | 25 | 30 | | | | 15 | | | | |
| | Paraffin wax | 40 | | 15 | | 9 | | 25 | 10 | | 20 |
| | Carnauba wax emulsion | | | | | | | | | 20 | |
| | Paraffin wax emulsion | | | | | | | | | | |
| | Softening agent | 5 | 5 | 5 | 2 | 2 | 5 | 5 | | | 5 |
| | Coloring agent | 30 | 25 | 30 | 18 | 4 | 20 | 10 | 20 | | 20 |
| | Coloring agent dispersion | | | | | | | | | 20 | |

In the table, "○" indicates "presence" and the numerals are those of parts by weight.

Material used in Examples 1-10 and their physical properties (1)

| | Material | Physical property: Melting point (°C.) | Softening point (°C.) | Molecular weight | Penetration | Melting viscosity (at 140° C.) | Remarks |
|---|---|---|---|---|---|---|---|
| Polyethylene resin | Oxide type low molecular weight PE | | 110 | 3200 | 4.0 | 550 | Acid value 5 |
| | Vinyl acetate copolymer type low molecular weight PE | | 95 | 3500 | 8.0 | 500 | Vinyl acetate 13% |
| | Acrylic acid copolymer type low molecular weight PE | | 102 | 3200 | 4.0 | 650 | |
| | Low molecular weight polyethylene A | | 110 | 6000 | 2.5 | 6000 | |
| | Dispersion of low molecular weight polyethylene A | | | | | | |
| | Low molecular weight polyethylene B | | 102 | 1500 | 7.0 | 180 | |
| Wax | Carnauba wax | 83 | | | | | |
| | Paraffin wax | 65 | | | | | |

Material used in Examples 1-10 and their physical properties (2)

| | Material | Physical property: Melting point (°C.) | Softening point (°C.) | Molecular weight | Penetration | Melting viscosity (at 140° C.) | Remarks |
|---|---|---|---|---|---|---|---|
| Wax | Carnauba wax emulsion | | | | | | |
| | Parafin wax emulsion | | | | | | |
| Softening agent | Mineral oil | | | | | | |
| Coloring agent | Carbon black | | | | | | |
| | Carbon black dispersion | | | | | | |

EXAMPLES 11-19 (1)

| | Material | EXAMPLE No. 11 | 12 | 13 | 14 | 15 | 16 | 17 | 18 | 19 |
|---|---|---|---|---|---|---|---|---|---|---|
| Heat-resistant | Fatty acid amide | ○ | ○ | ○ | ○ | ○ | ○ | ○ | ○ | ○ |

-continued

EXAMPLES 11-19 (1)

| | Material | EXAMPLE No. 11 | 12 | 13 | 14 | 15 | 16 | 17 | 18 | 19 |
|---|---|---|---|---|---|---|---|---|---|---|
| protective layer | | | | | | | | | | |
| Substrate | PET 4μ | ○ | ○ | ○ | ○ | ○ | ○ | ○ | ○ | ○ |
| Heat-sensitive releasing layer | Microcrystalline wax m.p. 84° C. | 100 | | | | 70 | 70 | 70 | 70 | 70 |
| | Montan wax m.p. 80° C. | | 100 | | | | | | | |
| | Microcrystalline wax emulsion | | | 100 | | | | | | |
| | Montan wax emulsion | | | | 100 | | | | | |
| | Polyamide | | | | | 20 | | | | |
| | polyethylene | | | | | | 30 | | | |
| | Rosin | | | | | 10 | | | | |
| | Coumarone-indene resin | | | | | | | 30 | | 20 |
| | Plasticizer(DOP DBP Oils) | | | | | | | | 30 | 10 |

EXAMPLES 11-19 (2)

| | Material | EXAMPLE No. 11 | 12 | 13 | 14 | 15 | 16 | 17 | 18 | 19 |
|---|---|---|---|---|---|---|---|---|---|---|
| Heat-sensitive transferring ink layer | Ink used (the numeral in the parentheses representes the number of Example) | (3) | (3) | (6) | (7) | (8) | (9) | (10) | (3) | (4) |

In the table, "○" stands for "presence" and the numerals are those of parts by weight.

The heat-sensitive transferring recording mediums produced according to the above-mentioned examples were tested by using a heat-sensitive printer (cycle, 1.2 m sec; impressed pulse width, 0.9 m sec; power, 0.5 W/DOT) and receiving paper having Bekk smoothness test of 16 sec, Hammermill bond paper (JIS P8119).

The results show that the products in Examples 1 and 2 (conventional products) gave many voids and low density while the products of Examples of 3–19 gave less void and good prints of high density, except for Example 5 which is a comparative example. See "Test Result" (infra).

EXAMPLES 20–28

To the upper surface of a 4μ thick PET (polyethylene terephthalate) was applied a fatty acid amide in the thickness of 1μ to form a heat-resistant protective layer. Then a coating material as shown in each of Examples was applied to the other surface to form a heat-sensitive releasing layer of 2μ thick, and further, to the surface of the resultant heat-sensitive releasing layer was applied a coating material as shown in the Examples to form a heat-sensitive transferring ink layer of 4μ thick.

EXAMPLES 20–28 (1)

| | Material | EXAMPLE No. 20 | 21 | 22 | 23 | 24 | 25 | 26 | 27 | 28 |
|---|---|---|---|---|---|---|---|---|---|---|
| Heat-resistant protective layer | Fatty acid amide | ○ | ○ | ○ | ○ | ○ | ○ | ○ | ○ | ○ |
| Substrate | PET 4μ | ○ | ○ | ○ | ○ | ○ | ○ | ○ | ○ | ○ |
| Heat-sensitive releasing layer | Paraffin wax | 100 | | | | 70 | 70 | 70 | 70 | |
| | Carnauba wax | | 100 | | | | | | | |
| | Paraffin wax emulsion | | | 100 | | | | | | |
| | Carnauba wax emulsion | | | | 100 | | | | | |
| | Ethylene-vinylacetate copolymer resin | | | | | 20 | 30 | | | |
| | Terpene resin | | | | | 10 | | | 30 | |
| | Terpene-phenolic resin | | | | | | | | | |
| | Low molecular weight polystyrene resin | | | | | | | | | 100 |
| | Polybutene | | | | | | | 20 | | |
| | Mineral oil | | | | | | | 10 | | |
| | * 30% solution in toluene | | | | | | | | | |

EXAMPLES 20–28 (2)

| | Material | EXAMPLE No. 20 | 21 | 22 | 23 | 24 | 25 | 26 | 27 | 28 |
|---|---|---|---|---|---|---|---|---|---|---|
| Heat-sensitive transferring ink layer | Carnauba wax | 25 | 20 | | 25 | 25 | 25 | 25 | 25 | 25 |
| | Paraffin wax | 40 | 40 | | 40 | 40 | 40 | 40 | 40 | 40 |
| | Paraffin wax emulsion | | | 75 | | | | | | |
| | Softening agent | 5 | 10 | | 5 | 5 | 5 | 5 | 5 | 5 |
| | Coloring agent | 30 | 30 | | 30 | 30 | 30 | 30 | 30 | 30 |

-continued

EXAMPLES 20-28 (2)

| Material | EXAMPLE No. 20 | 21 | 22 | 23 | 24 | 25 | 26 | 27 | 28 |
|---|---|---|---|---|---|---|---|---|---|
| Coloring agent dispersion | | | 25 | | | | | | |

In the table, ⊙ stands for "presence" and the numerals are those of parts by weight.

Test method:

The resulting mediums were tested by using a heat-sensitive printer (cycle, 1.2 m sec; impressed pulse width, 0.9 m sec; power, 0.5 W/DOT) and a receiving paper having Bekk smoothness test of 16 sec, Hammermill bond paper (JIS P8119).

The results are as shown in the table "Test Result" below. There were obtained good prints of less void and high density.

| EXAMPLE No. | Test Result Result Void | Density | Evaluation |
|---|---|---|---|
| 1 | X | Δ | X |
| 2 | X | Δ | X |
| 3 | ○ | ○ | ○ |
| 4 | ○ | ○ | ○ |
| 5 | Δ | Δ | Δ |
| 6 | ○ | ○ | ○ |
| 7 | ○ | ○ | ○ |
| 8 | ○ | ○ | ○ |
| 9 | ○ | ○ | ○ |
| 10 | ○ | ○ | ○ |
| 11 | ⊙ | ⊙ | ⊙ |
| 12 | ⊙ | ⊙ | ⊙ |
| 13 | ⊙ | ⊙ | ⊙ |
| 14 | ⊙ | ⊙ | ⊙ |
| 15 | ⊙ | ⊙ | ⊙ |
| 16 | ⊙ | ⊙ | ⊙ |
| 17 | ⊙ | ⊙ | ⊙ |
| 18 | ⊙ | ⊙ | ⊙ |
| 19 | ⊙ | ⊙ | ⊙ |
| 20 | ○ | ○ | ○ |
| 21 | ○ | ○ | ○ |
| 22 | ○ | ○ | ○ |
| 23 | ○ | ○ | ○ |
| 24 | ○ | ○ | ○ |
| 25 | ○ | ○ | ○ |
| 26 | ○ | ○ | ○ |
| 27 | ○ | ○ | ○ |
| 28 | ○ | ○ | ○ |

⊙ Best
○ Good
Δ Passable
X Poor

What is claimed is:

1. A thermal printing ribbon which comprises a heat-resistant substrate, a heat-sensitive releasing layer and a heat-sensitive transferring ink layer laminated in this order, the heat-sensitive transferring ink layer consisting essentially of (a) a polyethylene resin having a melting point or softening point of 60°-150° C., molecular weight of 1,000-100,000, penetration of 20 or less (at 25° C.) (JIS K 2235) and melting viscosity of 100-10,000 cps (at 140° C.), (b) a wax having a melting point of 50°-110° C. and (c) a coloring agent, and the contents of (a), (b) and (c) components being 50-80 % by weight, 0-30% by weight and 5-45% by weight after drying, respectively.

2. A thermal printing ribbon according to claim 1 in which the heat-resistant substrate is constituted of a plastic film provided with a heat-resistant protective layer.

3. A thermal printing ribbon according to claim 1 in which the heat-sensitive releasing layer melts at 50°-100° C.

4. A thermal printing ribbon according to claim 3 in which the releasing layer consists essentially of 40-90% by weight of a wax, 0-40% by weight of a thermoplastic resin and 0-30% by weight of a softening agent.

5. A thermal printing ribbon according to claim 3 in which the releasing layer consists essentially of (a) a wax having a melting point of 50°-100° C., (b) one or more of thermoplastic resins having a softening point or a melting point of 60°-150° C., and (c) a softening agent which is liquid at room temperature, the contents of (a), (b) and (c) being 100-30% by weight, 10-60% by weight and 0-30% by weight, respectively.

6. A thermal printing ribbon according to claim 3 in which the releasing layer comprises at least one member selected from the group consisting of rosin, and derivatives thereof, terpene resin, hydrocarbon resins, α-methylstyrene-vinyltoluene copolymer, low molecular weight styrene resins, and coumarone-indene resins.

7. A thermal printing ribbon according to claim 3 in which the releasing layer is composed of a wax emulsion.

8. A thermal printing ribbon according to any one of claims 3-7 in which the heat-resistant substrate is a plastic film provided with a heat-resistant protective layer.

9. A thermal printing ribbon which comprises a heat-resistant substrate, a heat-sensitive releasing layer and a heat-sensitive transferring ink layer laminated in this order, the heat-sensitive transferring ink consisting essentially of (a) a low molecular weight oxidized polyethylene resin having an acid value of 5-30, a melting point or softening point of 60°-150° C., molecular weight of 1,000-100,000, penetration of 20 or less (at 25° C.) (JIS K 2235) and melting viscosity of 100-10,000 cps (at 140° C.), (b) a wax having a melting point of 50°-110° C., and (c) a coloring agent, and the contents of (a), (b) and (c) components being 50-80% by weight, 0-30% by weight and 5-45% by weight after drying respectively.

10. A thermal printing ribbon according to any one of claims 1, 2 and 9 in which the polyethylene resin is in a form of emulsion and/or aqueous dispersion.

* * * * *